US006431831B1

(12) United States Patent
Addie et al.

(10) Patent No.: US 6,431,831 B1
(45) Date of Patent: Aug. 13, 2002

(54) PUMP IMPELLER WITH ENHANCED VANE INLET WEAR

(75) Inventors: Graeme R. Addie, Augusta, GA (US); Peter Hergt, Frankenthal (DE)

(73) Assignee: GIW Industries, Inc., Grovetown, GA (US)

( * ) Notice: Subject to any disclaimer, the term of this patent is extended or adjusted under 35 U.S.C. 154(b) by 0 days.

(21) Appl. No.: 09/641,430

(22) Filed: Aug. 18, 2000

Related U.S. Application Data

(60) Provisional application No. 60/150,053, filed on Aug. 20, 1999.

(51) Int. Cl.[7] ..... F04D 29/24

(52) U.S. Cl. ..... 415/206; 416/186 R; 416/223 B

(58) Field of Search ..... 415/204, 206, 415/121.1; 416/183, 185, 186 R, 188, 223 B

(56) References Cited

U.S. PATENT DOCUMENTS 2,013,455 A * 9/1935 Baxter ..... 415/206
4,676,714 A * 6/1987 Fukazawa et al. ..... 415/203
4,826,402 A * 5/1989 Nachtrieb ..... 415/206
4,854,820 A * 8/1989 Zolotar et al. ..... 416/186 R
4,923,369 A * 5/1990 Addie et al. ..... 415/206
5,797,724 A * 8/1998 Liu et al. ..... 415/206
5,813,833 A * 9/1998 Addie et al. ..... 415/206
6,053,698 A * 4/2000 Hergt et al. ..... 415/206

FOREIGN PATENT DOCUMENTS

SU 1219840 A * 3/1986 ..... 416/223 B
WO WO-97/47889 A1 * 12/1997 ..... 415/206

* cited by examiner

*Primary Examiner*—Christopher Verdier
(74) *Attorney, Agent, or Firm*—Womble Carlyle Sandridge & Rice, PLLC

(57) ABSTRACT

Disclosed is a centrifugal pump having inlet blade angles set to an angle which takes into account the velocity of the solids moving within a slurry steam to reduce the wear on the centrifugal pump. The centrifugal pump includes an impeller for moving the slurry. The impeller includes a plurality of vanes, wherein each vane has an inlet angle optimized for providing a substantially shock-free entry of slurry into the pump relative to a velocity profile of the solids contained within the lower half of the slurry profile to reduce wear on the pump.

13 Claims, 9 Drawing Sheets

(a) Velocity triangle at entry.

(b) Velocity triangle at exit.

PUMP IMPELLER WITH ENHANCED VANE INLET WEAR

This application claims the benefit of U.S. Provisional Application No. 60/150,053 filed Aug. 20, 1999.

FIELD OF INVENTION

The present invention relates to centrifugal pumps, and more particularly to centrifugal pumps used for transporting slurries and other abrasive-containing fluids.

BACKGROUND

A centrifugal pump consists basically of a rotatable impeller enclosed by a collector or shell. As the impeller is rotated, it generates velocity head at the periphery of the shell. The shell collects the velocity head and converts it to a pressure head. There are many configurations within the framework of this basic design. In one common configuration, the flow enters the shell at a point adjacent to the center of the impeller, referred to as the "eye" of the impeller, while the discharge of the shell is located at a point tangent to the shell's outer periphery.

The magnitude of the head is largely determined by the impeller diameter, and the flow is mostly affected by the width of the pump and the size of the internal section area. The shell and the impeller tend to work like two nozzles in series, with the impeller generating, and the shell collecting, the head. A change to either will affect the head and the flow. Because both can be varied, more than one combination of variables of impeller and shell dimensions can achieve the same effect.

The magnitude of the peak efficiency is largely determined by the efficiency of the impeller and the wetted geometry in generating and collecting the head and flow. The location of the best efficiency point (BEP) is affected in large part by the magnitude (width and depth) of the hydraulic sections. Larger hydraulic sections cause the location of the BEP to move to higher flows.

With regard specifically to slurry pumps, these pumps are subject to high wear due to the abrasive effect of particles in the slurry, which through impact and friction erode the various pump surfaces.

As a consequence, slurry pump hydraulic sections have tended toward sizes larger than absolutely necessary in order to keep velocities down, since velocity is a large factor in the wear process. Decreased wear, however, comes at the expense of pump efficiency, since the pump is not operated at or near the BEP. This results in overall increased costs of operation. Thus, there is a need in the art for slurry pumps with increased wear characteristics.

SUMMARY

The present invention provides a centrifugal pump having inlet blade angles set to an angle which takes into account the velocity of the solids moving within a slurry steam to reduce the wear on the centrifugal pump. Slurries are often striated where the lower half of the slurry stream contains a greater percentage of solids than the upper half. The solids in the lower half have a velocity which is significantly less than the liquid component of the remaining slurry steam. Thus, by optimizing the inlet blade angle to correspond to the velocity of the slower moving solids, wear on the centrifugal pump can be significantly reduced.

In an embodiment, the present invention provides a centrifugal pump for pumping a slurry containing a solids fluid mixture. The centrifugal pump has a shell with a central axis that includes a front wall and a spaced back wall, a generally continuous outer side wall extending between the front wall and the rear wall and a discharge nozzle disposed tangentially with respect to the side wall. Additionally, a suction inlet is included that is defined in the front wall about the axis for allowing the slurry to enter the shell and an impeller is rotatably supported within the shell about the central axis. The impeller includes a plurality of vanes, wherein each vane has an inlet angle and an exit angle. The vane inlet angles provide a substantially shock-free entry for the solids fluid mixture entering the impeller.

Furthermore, the present invention provides a centrifugal pump for pumping a slurry containing a solids fluid mixture. The centrifugal pump has a shell with a central axis that includes a front wall and a spaced back wall, a generally continuous outer side wall extending between the front wall and the rear wall and a discharge nozzle disposed tangentially with respect to the side wall. Additionally, a suction inlet is included that is defined in the front wall about the axis for allowing the slurry to enter the shell and an impeller is rotatably supported within the shell about the central axis. The impeller includes a plurality of vanes, wherein each vane has an inlet angle optimized for providing a substantially shock-free entry of slurry into the pump relative to a velocity profile of the solids contained within the lower half of the slurry profile.

DETAILED DESCRIPTION

The present invention provides a centrifugal pump having inlet blade angles set to an angle which takes into account the velocity of the solids moving within a slurry steam to reduce the wear on the centrifugal pump. The centrifugal pump includes an impeller for moving the slurry. The impeller includes a plurality of vanes, wherein each vane has an inlet angle optimized for providing a substantially shock-free entry of slurry into the pump relative to a velocity profile of the solids contained within the lower half of the slurry profile to reduce wear on the pump.

Figure 1B:
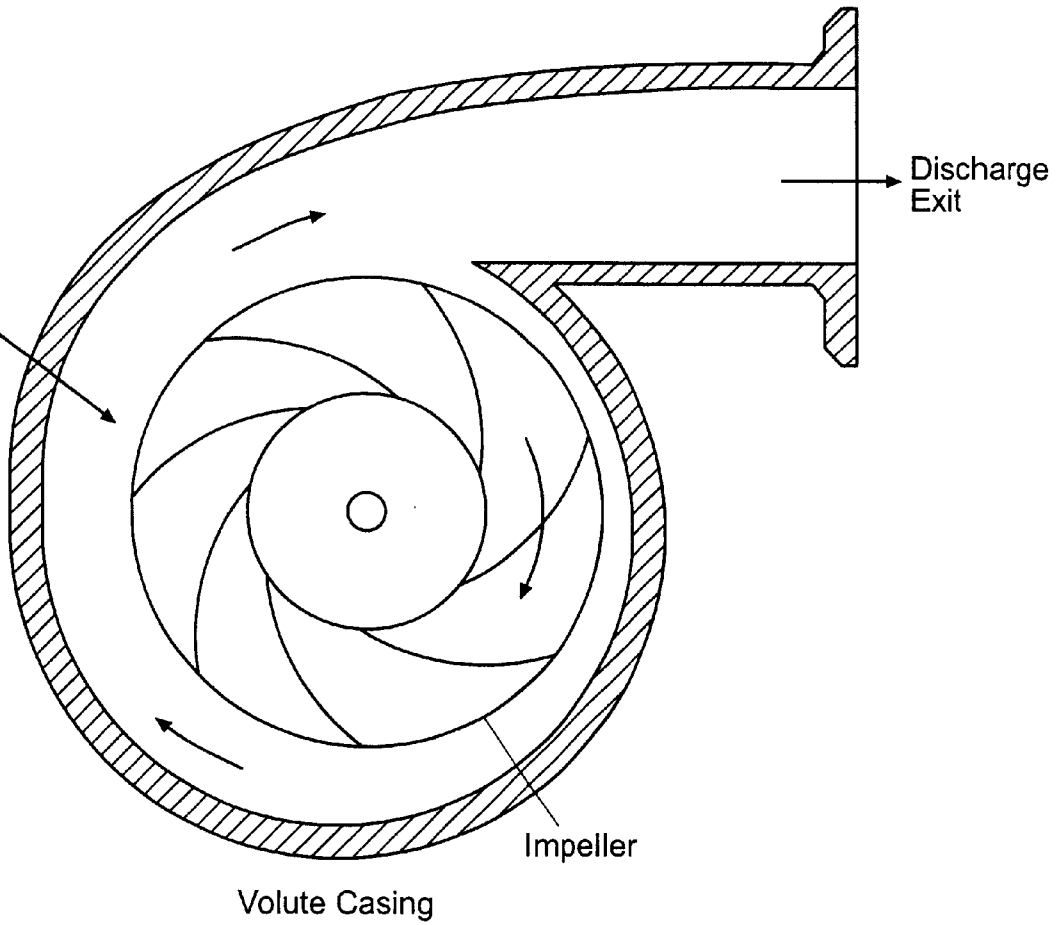
FIGS. 1A and 1B are cross sectional views of a representative slurry pump.
Figure 1A:
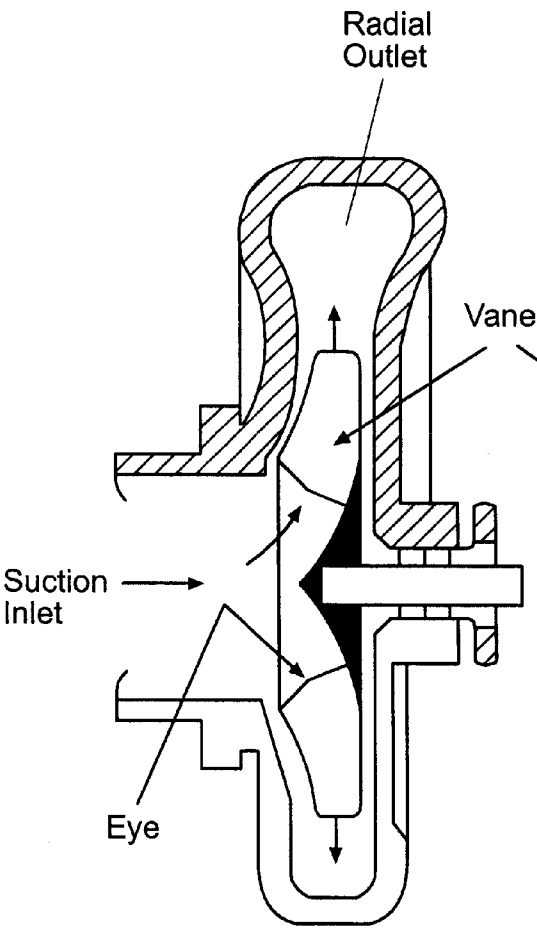

In an embodiment, as illustrated in FIG. 1, an end-suction single-stage volute-casing pump is shown. The centrifugal pump typically has two main components: the first is the routing element comprising the shaft and impeller, including the vanes which act on the fluid; the second is the stationary element made up of the casing or shell which encloses the impeller, together with the associated stuffing boxes and bearings. In any hydraulic pump design, there is usually more than one combination of component dimensions that can be arranged to give the required specified performance characteristics. The combination selected will depend on the intended application, and on any hydraulic or mechanical limitations. In slurry pumps, a number of limitations are imposed. These include the need to pass large solids, the requirement for a robust rotating assembly because the slurry density exceeds that of water, and the desirability of thicker sections in order to minimize the effects of wear.

Figure 2:
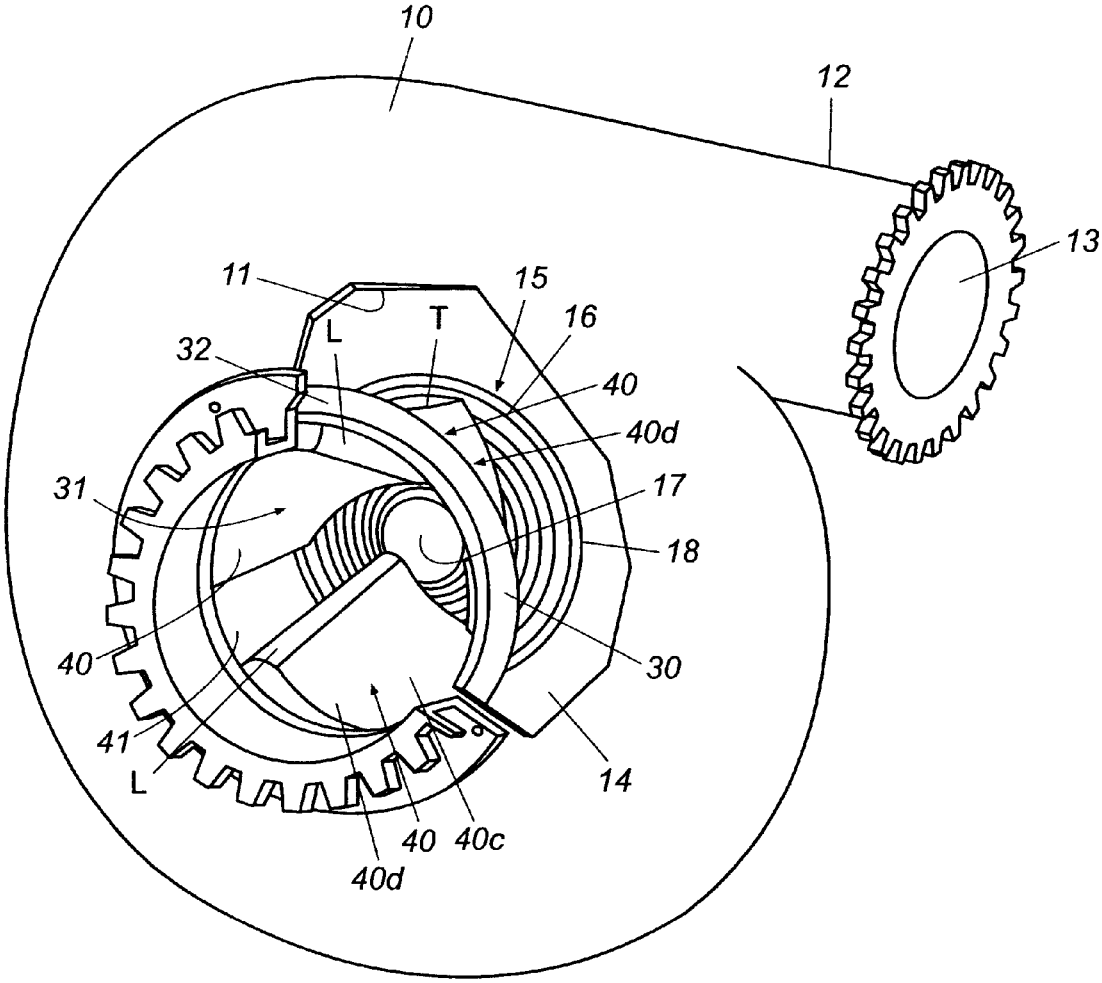
FIG. 2 is a detailed schematic of a slurry pump showing the vanes and inlet of the slurry pump.

In greater detail as illustrated in FIG. 2, the shell 10 has a hollow central interior 14 which receives the impeller, denoted generally by the numeral 15. Impeller 15 includes a disc-shaped back shroud 16 with a bulbous forwardly protruding central hub 17 of smaller diameter than the diameter of the back shroud 16. The central portion of the rear side of the back shroud 16 is internally threaded and receives the threaded end of a drive shaft, as seen in FIG. 1. This drive shaft protrudes away from the back shroud 16 and bearings within a pair of spaced, aligned pillar blocks mounted on a common support block journal shaft. A motor common in the art (not shown) rotates the shaft and the impeller 15 within shell 10. The packing common in the art (not shown) for surrounding shaft in the central portion of the back side of the shell 10, prevents leakage as the slurry is pumped.

Forward to the back shroud 16 is an open annular shroud 30 which has a larger outside diameter than the diameter of the back shroud 16. This shroud 30 includes a circular central opening or intake 31. The shroud 30 is concentric with the back shroud 16 about the main axis β of the pump 10 and shaft 20. The periphery of the shroud 30 is machined to form a circular front surface 32 which is concentric with the remainder of the impeller 15. The rear shroud 16 includes a similar rear bearing surface 18 which rides against the appropriate wearing ring (not shown) within the interior of the shell 10. Extending between the shroud 30 and the rear shroud 16 are three circumferential, equally spaced mixed pitch vanes 40, the inlet angles 40*a* of which are respectively integrally secured to the front surface of the back shroud 16. The exit angles 40*b* of these vanes 40 are secured to the back surface of the annular shroud 30. Preferably, the impeller 15 is cast as an integral unit out of white iron or some other wear-resistant material.

In an embodiment, the vanes 40 protrude essentially forwardly form a back shroud 16, the inlet angles 40*a* of each vane preferably occupying an arc or sweep of about 105° along the front surface of back shroud 16 and the exit angles 40*b* of each vane occupying an arc or sweep along the back surface of the annular shroud 30. Each vane 40 is substantially similar to the other, the vanes 40 being spaced throughout the circumference of the impeller 15. Each vane 40 has a thickness at the inlet end of the impeller 15 in a range of about 2% to 5% of the suction diameter. Each vane 40, has a body which occupies about 7% of the suction diameter and each vane 40, at its tip, or inlet angles 40*a* occupies in a range of 2% to 5% of the suction diameter.

The shell or casing 10 has a radial geometry in the plane of the impeller 15. The width of the collector shell 10, in cross-section, may vary somewhat, but is normally about 60% of the suction diameter.

To describe the centrifugal pump in greater detail, certain directions or coordinates must be specified to aid in describing the function of the inlet angles 40*a* of the vanes 40. The axial direction is parallel to the shaft 20 of the pump, and positive in the direction of the axial component of the inflow, and the radial direction is directly outward from the centerline of the shaft 20. The tangential direction is perpendicular to both axial and radial directions, representing the tangent to the circular path of a rotating point. Points on the impeller 15 have only tangential velocity, given by ω or 2πnr where ω is angular velocity in radians per second, n is in revolutions per second, and r is the radius from the shaft centerline. A further direction, needed for mixed-flow pumps, is the meridional direction. This direction lies within a plane passing through the shaft centerline, and follows the projection of the fluid streamlines onto this plane. Thus, the meridional direction has both radial velocity triangles direction for a pump and a radial flow.

The meridional and tangential velocities are used to plot the velocity triangles at the entry and exit of the impeller 15. The 'absolute' velocity of the fluid (i.e. its velocity measured relative to the ground) is denoted by c, with subscript m for the component in the meridional direction and u or t for the tangential direction. The absolute velocity of a point on the rotating impeller, denoted by u, is necessarily in the tangential direction, so a directional subscript is not required in this case. Further, the subscripts 1 and 2 are used to distinguish conditions at the entry and exit of the impeller 15, respectively. The velocity triangles are shown on FIG. 2. It should be noted that the velocity 2, which closes the vector triangle, represents the velocity of the fluid relative to the impeller. As this velocity will follow the inclination of the blades, the angle β shown in the vector triangles will represent the blade angle, i.e. the angle between the impeller blade and a plane tangent to the impeller 15. The exit blade angle $\beta_2$ is an important design parameter, and the entry blade angle $\beta_1$ is set to minimize energy loss as the fluid enters the impeller 15.

The vector triangles provide the information required for solving the moment of momentum equation. In its simplest form, applicable when conditions do not vary with time, the equation states the applied torque T must equal the moment of the net momentum flux passing through a stationary control volume. As the control volume is stationary, i.e. based on the ground not the impeller 15, the velocities used in calculating the momentum flux must also be 'absolute' or ground-based ones (for this reason absolute velocities were used for the vector triangles).

Figure 10A:
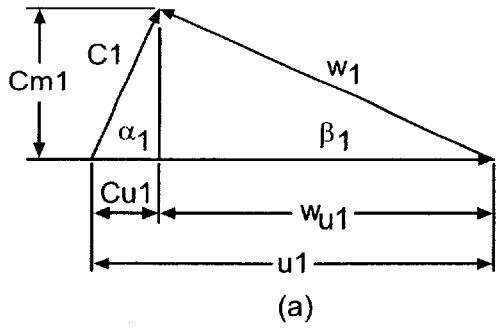
FIGS. 10*a* and 10*b* illustrate the velocity vectors for the entry and exit velocities.
Figure 10B:
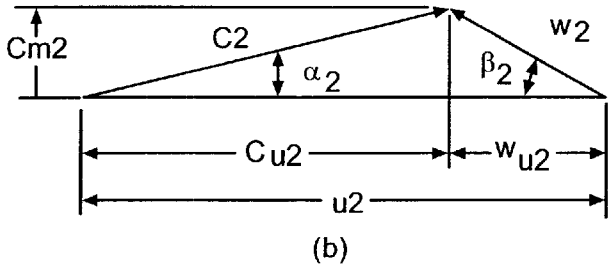

Referring to variables displayed in FIG. 10, it can be shown that $$T=\rho_f Q[c_{t2}r_2-c_{t1}r_1]. \quad (1)$$

Multiplying equation (1) by Ω gives the power, and on dividing both sides of the resulting equation by Q and g, one obtains $$H_1=[u_2c_{t2}-u_1c_{t1}]/g \quad (2)$$

As losses have been disregarded, Hι is a theoretical head. Equation (2) is often called the Euler equation, after its originator (Euler, 1756). The term $u_1c_{t1}$ refers to the flow entering the eye of the impeller 15, and at the best efficiency point this term effectively reduces to zero. Thus, it is ignored when considering the idealized machine with efficiency of 100%.

The vector diagram at the exit of the impeller 15 shows that $$c_{2t}=u_2-c_{m2}cot\ \beta_2, \tag{3}$$

where $c_{m2}$ is the meridional component of outlet velocity (directed radially outward for most slurry pumps), which in turn is given by the discharge Q divided by the exit area of the impeller 15, or $$C_{m2}=\frac{Q}{\pi D_1 b_2}, \tag{4}$$

Where $b_2$ is the breadth between the shrouds at the outlet of the impeller 15.

Equation (4) together with the evaluation of $u_2$ as $\pi nD_2$, can then be substituted into equation (3) and the result combined with equation (2), with the final term of the equation ignored for the ideal case. The result forms the basic head relation for the ideal pump, written $$\frac{gH_i}{n^2D_2^2}=\pi^2-\frac{Q}{nD_2^3}\left(\frac{D_2}{b_2}\cot\beta_2\right). \tag{5}$$

The ratio $D_2/b_2$ and the blade angle $\beta_2$ will both be constant for all members of a set of geometrically similar pumps. Thus, the head-capacity curve for a typical pump at constant speed will give a single straight line when plotted on the axis system of FIG. 3.

Real H-Q characteristics lie below the theoretical straight line, approaching it only near the best efficiency point. However, conditions near this point are of greatest practical interest.

Figure 11:
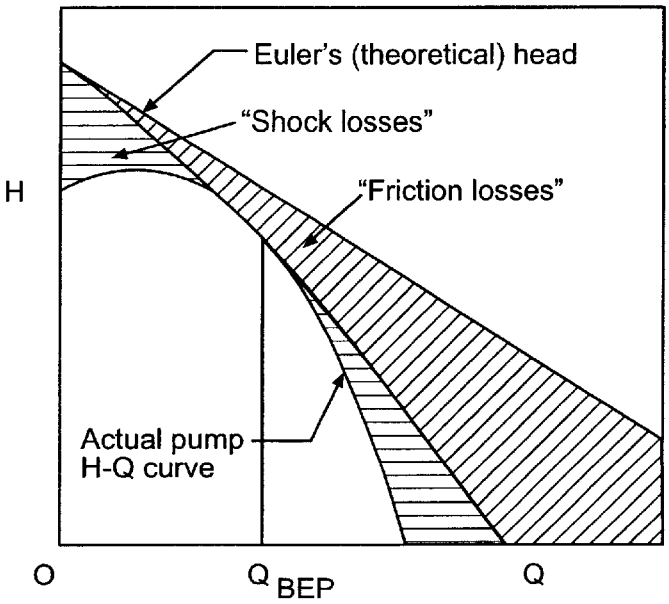
FIG. 11 is a chart illustrating the head-discharge curve.

The volute or casing of a pump has the task of converting the kinetic energy of the fluid leaving the impeller 15 into pressure energy. In an idealized pump, it is considered that there are no losses in either the casing or the impeller 15. In practice, hydraulic losses occur in all the wetted passages of the pump. The head-capacity curve of an actual pump results from the subtraction of losses from the idealized pump characteristic, on the basis that there is only a single discharge for which the shock loss at the impeller inlet is zero. An example is shown in FIG. 11 wherein the head-discharge curve obtained by the subtraction of hydraulic losses from the ideal line is illustrated.

Slurry pumps require thick sections and flow passages capable of passing large spheres, and as a result they have head performance coefficient values which differ from those of water pumps. It is likely, for example, that a slurry pump will require large impeller outlet widths than a water pump.

In the idealized case, an impeller with a large number of infinitely thin frictionless vanes would produce the highest efficiency in a pump. In practice, for a water pump this number ranges from five to nine. In a slurry or sewage pump, it may be reduced to three or four in order to pass coarse solids and accommodate extra vane thickness. Fewer vanes result in a steeper H-Q curve and some reduction in efficiency. The reduction in efficiency can be held to 1 or 2% in most cases. The number of vanes to be used must be decided after considering the size of solids to be passed, the vane thickness, the location of the inlet and the overall design of the vane shape. To hold the efficiency loss to a minimum, the vanes should have the correct inlet angle for shock-free entry of the fluid at the design point, the outlet should be set to give the desired performance, and the shape between the inlet and outlet should minimize the rate of change of velocity.

In reality, the meridional section of the impeller and the location of the inlet edge almost always impose a flow across this edge that is a combination of axial and radial motion. As the tangential velocity of the inlet edge of the vane varies, the inlet angle that gives shock-free entry will also vary.

This implies that twisted vanes are required for highest efficiency, and that radial vanes are necessarily a less efficient compromise solution.

The impeller inlet angle is calculated to give shock-free entry at the pump design flow with some volumetric recirculation efficiency allowance. This is usually assumed to be 95%.

The impeller meridional section and location of the inlet edge are almost always such that flow across the inlet edge is a combination of axial and radial movement. The tangential velocity of the inlet edge of the vane varies so that the inlet angle that gives shock-free entry will vary also.

Figure 3:
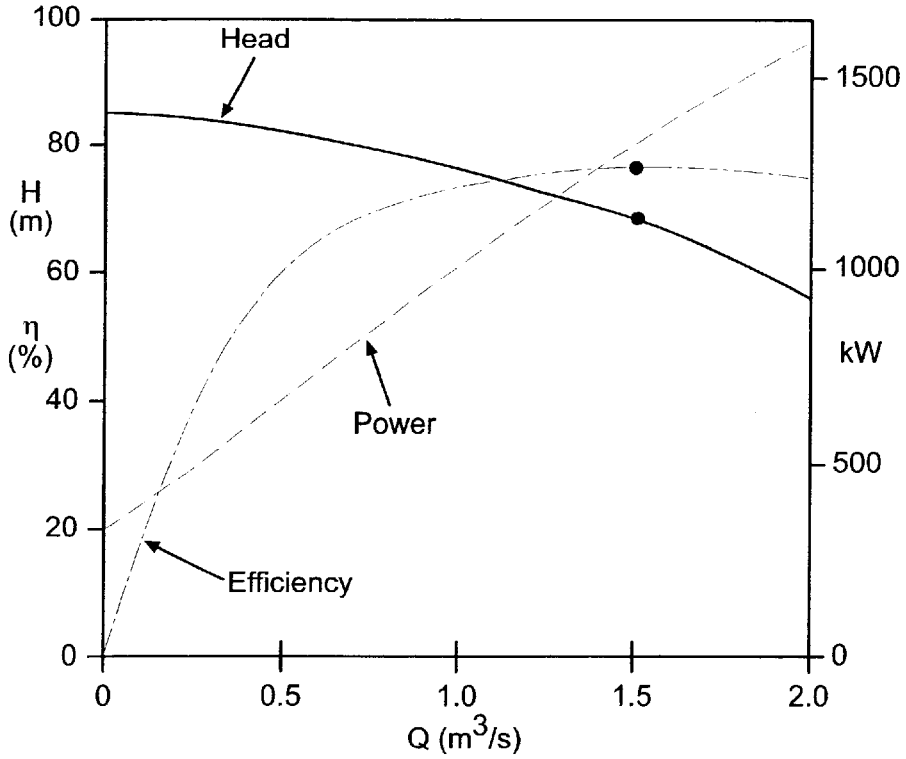
FIG. 3 is a chart illustrating a representative pump characteristic curves.

To get the inlet angle, it is normal to break the flow down into a series of streamtubes of equal volumes using a series of tangential circles across a section as shown in FIG. 3 where the product of the radius and diameter of the circles across a section remain constant.

Figure 12:
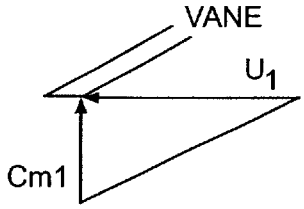
FIG. 12 illustrates the inlet angle vectors.

The inlet angle of the vane at the center of each streamtube can then be calculated using the relation below and as illustrated in FIG. 12.

$$\beta^1=\text{artan}\frac{C_{m1}}{U_1}\ \text{(for radius location r only)}$$

Where:

t is the vane thickness $C_{m1}$ is the meridional velocity at the center of the streamtube in the plane of the streamline.

$U_1$ is the tangential velocity of inlet edge of vane.

Since the vane has thickness (and reduces the area available), some allowance must be made for volumetric losses, the value of $C_{m1}$ must be found from the following:

$$C_{m1}=\frac{Q}{d\cdot(2\pi r_2-t\cdot Z/\sin\beta_1)\cdot\eta_v\cdot s}. \tag{6}$$

Q=design flow s=number of streamtubes

Z=number of vanes

D=width of streamtube

Since $\beta_1$ appears in both the equations, a trial and error solution must be carried out to find a value that satisfies both.

All of the above assumes that the incoming flow velocity distribution is constant across the inlet pipe cross section.

The streamtube calculations are being done for each of the four (or more) streamtubes. The blade inlet angle is then based on an interpolated value of the inlet angle taken from a curve of the four (or more) calculated inlet angles plotted against radial location.

The calculation of the velocity of the solids within the slurry is typically done as an estimate, since slurries composed of particles over 150 micron in size will slow relative to the mean carrier fluid velocity and concentrate towards the bottom of the pipe. Thus, determining the concentration of particles and their velocity in a given pipe size at different flow rates is important.

To solve the inlet angle, there must be an estimate determined for the velocity of the solids within the slurry.

Figure 4:
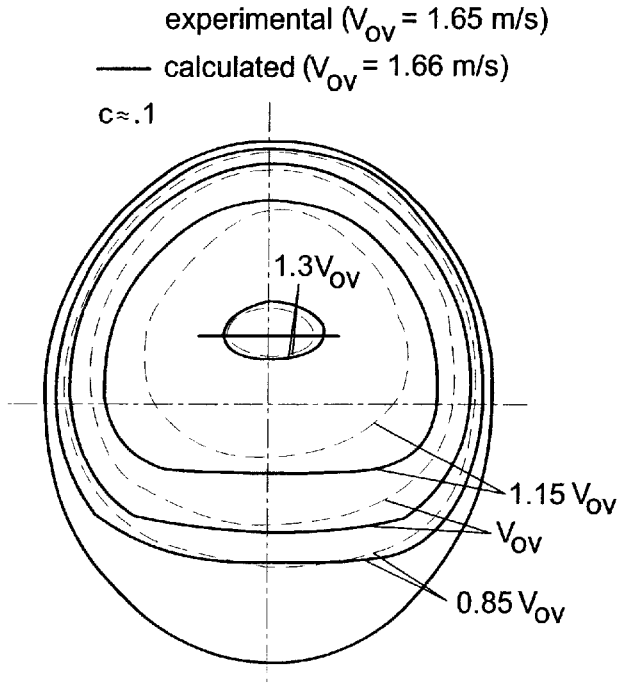
FIG. 4 is a chart illustrating the experimental and computed isolves in a 51.5 mm pipeline.
Figure 5:
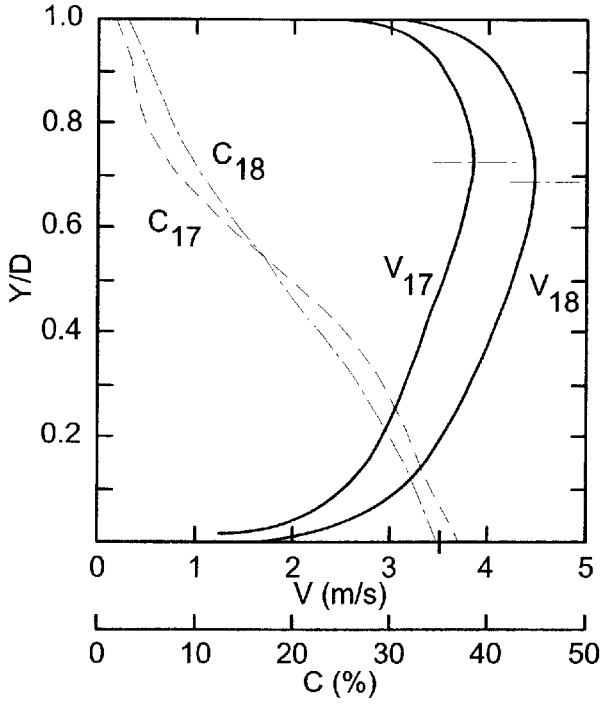
FIG. 5 is a chart illustrating the concentration and velocity distributions in a 49.5 mm pipeline.

The velocity estimate for the solids can be determined using various methods, or such method can be based upon the work of Roco and Shook, in papers presented in 1983 (Powder Technology) and 1984 (Journal of Pipelines). This work shows the measurement and calculations for 165 micron sized sand slurries in pipe sizes from 51.6 m up to 495 m, some of which are illustrated in FIGS. 4 and 5.

Figure 13:
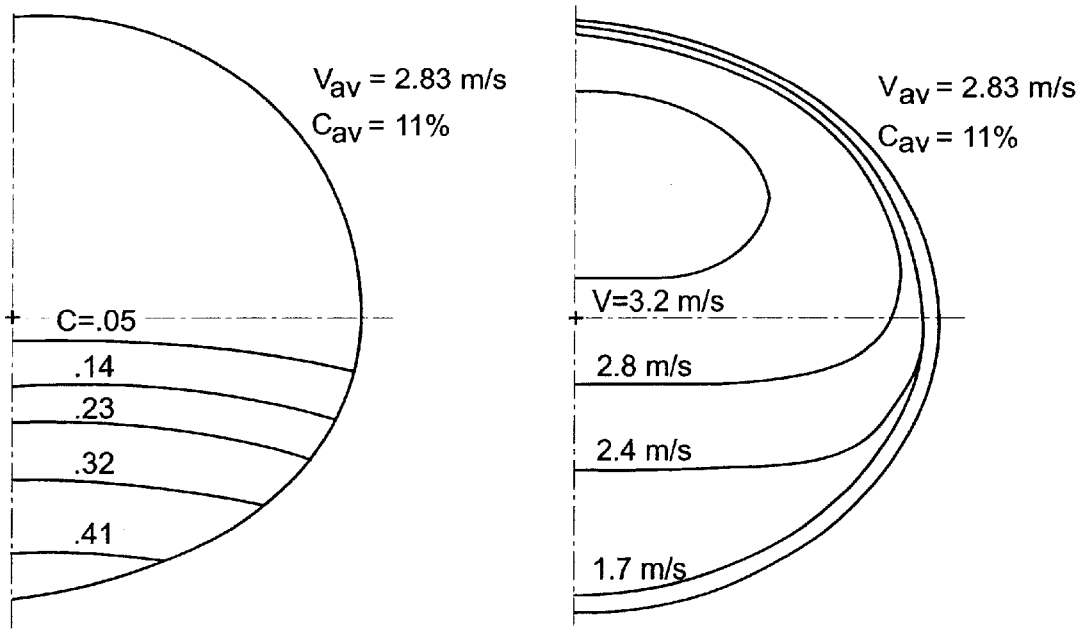
FIG. 13 is a chart illustrating the computational results in a pipe cross-section.

The results for a coarser slurry of size d=0.7 m flowing in a 75 mm diameter pipe taken from a paper by Roco and Cader given at the Internal & External Protection of Pipes Conference in Nice, France in 1985, reproduced in FIG. 13 showing a more graded concentration where less than 5% by volume of the solids are conveyed in the top section of the pipe.

The lower the mean velocity of the fluid in the pipe the slower the particles move until a stationary bed forms.

Figure 6:
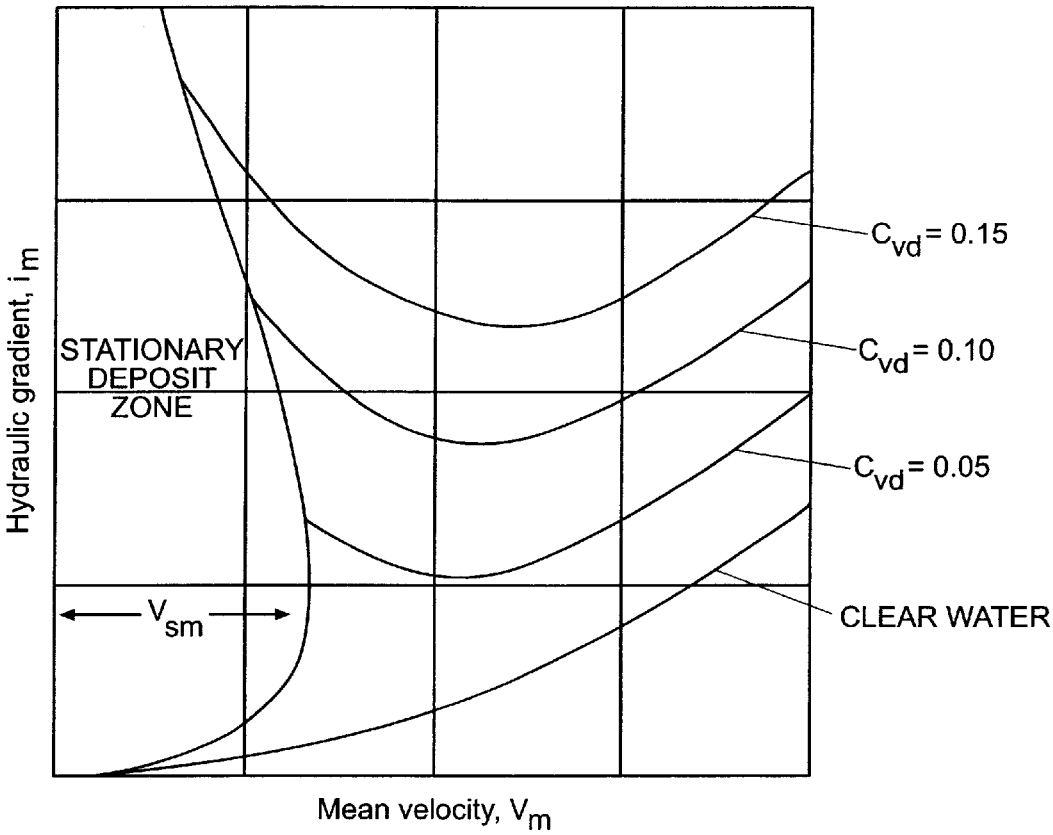
FIG. 6 is a chart illustrating the limit of stationary deposit zone.
Figure 7:
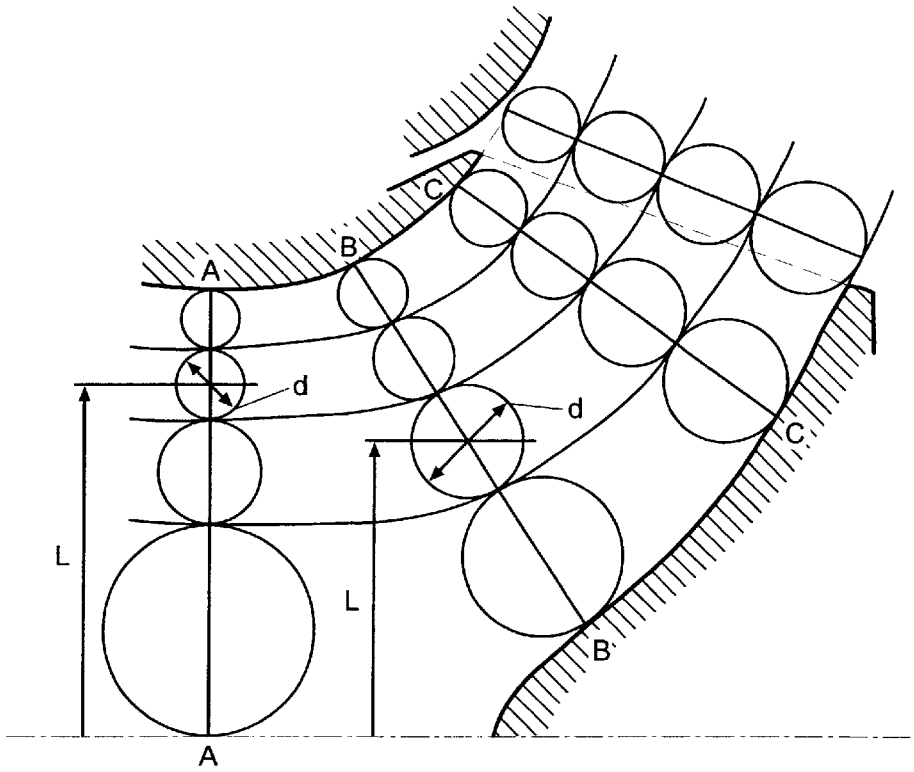
FIG. 7 illustrates the determination of the meridional stream lines.

The velocity at which deposit starts denoted $V_{sm}$, is shown diagrammatically in FIG. 6.

Figure 14:
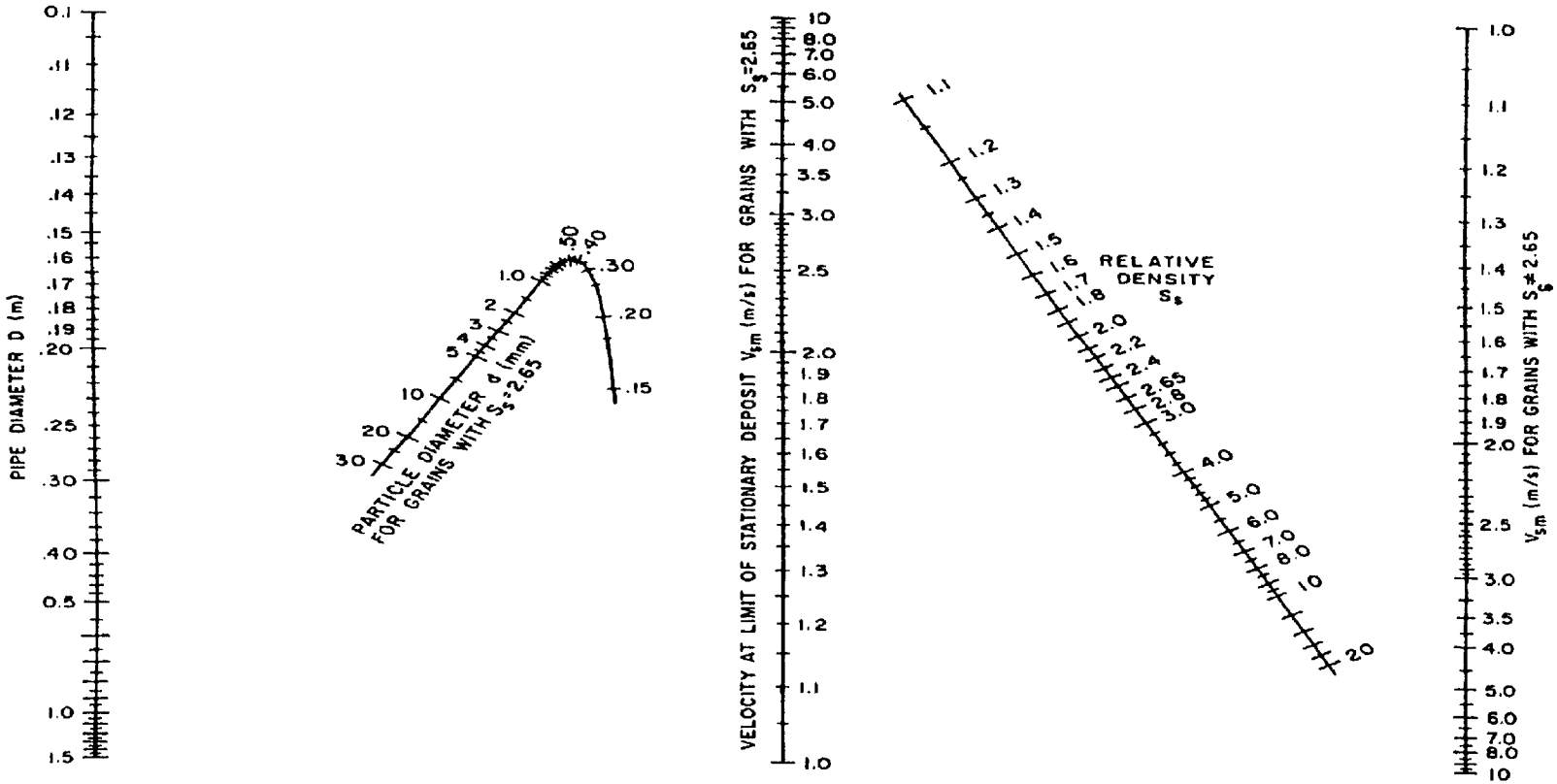
FIG. 14 is a chart illustrating a nomographic chart for maximum velocity at the limit of stationary deposition.

The value of $V_{sm}$ depends on internal pipe, particle diameter and relative density, and the effect of these variables is expressed concisely by a nomographic chart which was developed at Queen's University (Wilson and Judge, 1978; Wilson, 1979) with the help of Professor F. M. Wood's expertise in nomography (Wood, 1935). FIG. 14 illustrates a nomographic chart for maximum velocity at limit of stationary deposition.

The value of the above is in establishing a limit (which is determined easily) which could be used with the work of Roco to estimate the velocity of the particles at different design flows.

Additionally, the centrifugal pump may operate at an efficiency of between about 75–95% and the solids particle size may be at least about 100 microns. The slurry concentration may be about 10–30% solids.

Example

The original design of a 1.12 meter diameter, 510 mm diameter suction, 460 mm diameter discharge five-vane LSA44 pump covered by GIW drawing 5729D was carried out for a mean flow of 1052 l/sec while running at 400 rpm assuming there is an even velocity distribution of fluid coming into the eye. This results in meridional velocities of approximately 4.3 m/sec in the impeller eye.

Figure 9:
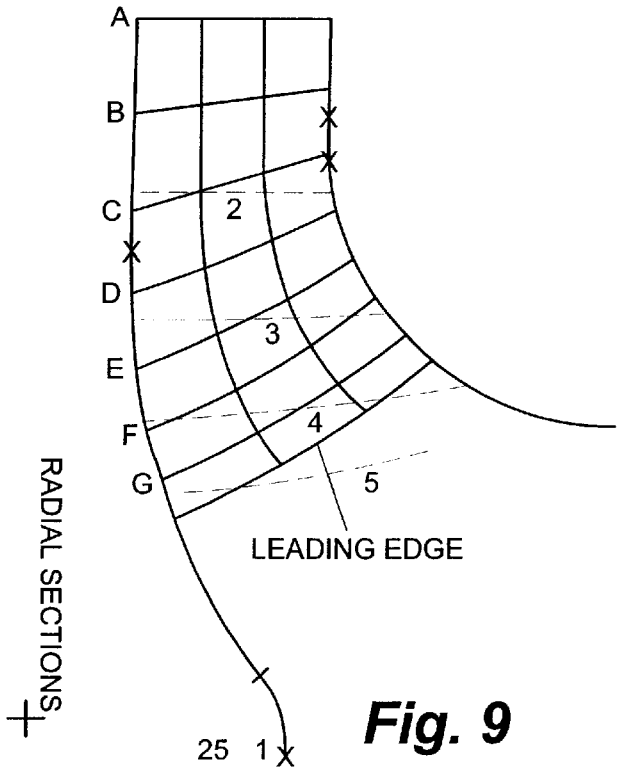
FIG. 9 is a chart illustrating the vane section and edge.
Figure 8:
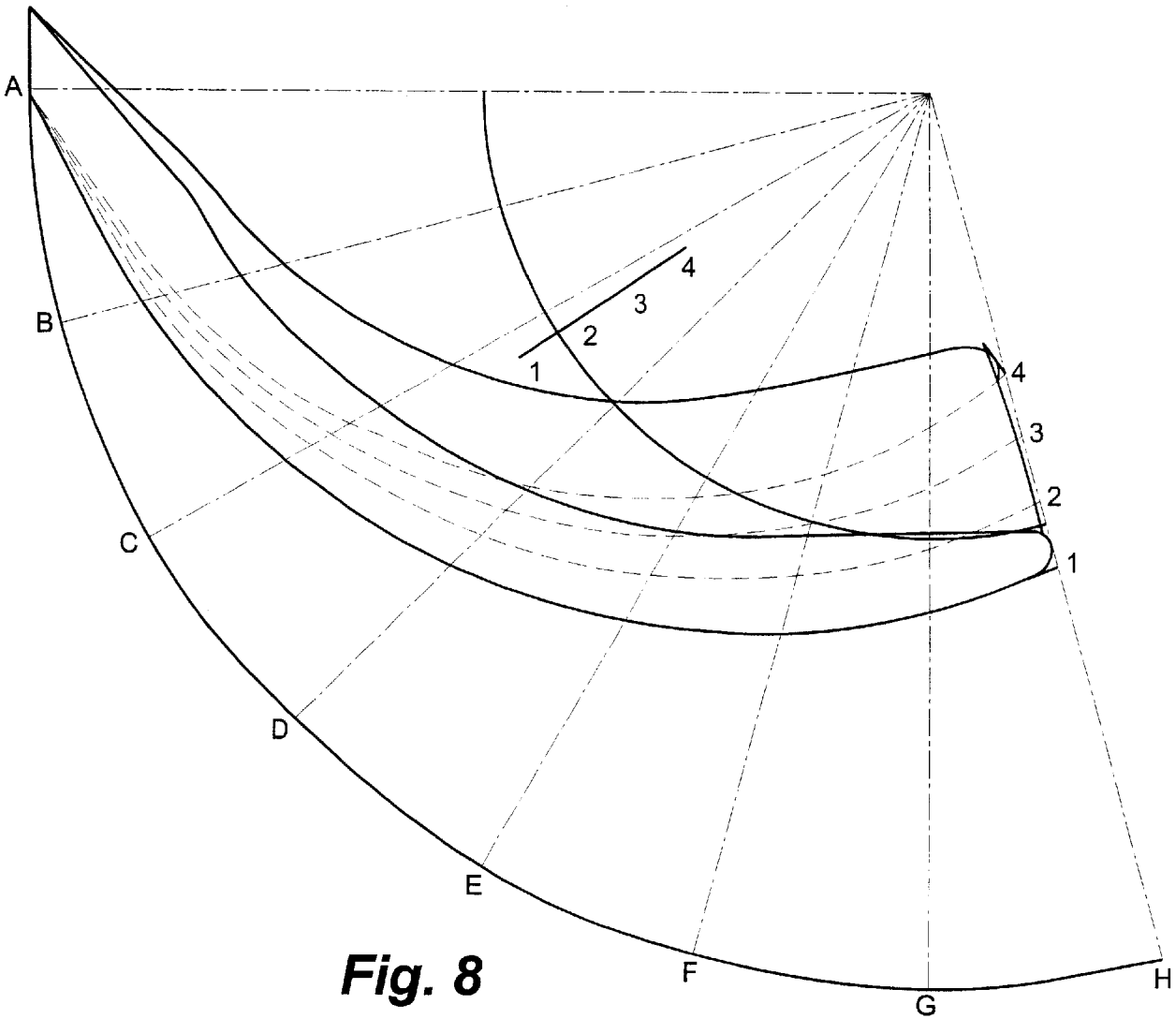
FIG. 8 is a chart illustrating the vane layout.

Assuming an even incoming velocity distribution this with a vane inlet edge thickness of 25 mm results in an inlet angle of 20, 22.5 and 27 over the three equal volume streamtubes from the front shroud to the back shroud with 15 degree leading edge vane sections and plan view as shown in FIGS. 8 and 9.

While specification embodiments have set forth as illustrated and described above, it is recognized that variations may be made with respect to disclosed embodiments. These can include other known continuous or discontinuous process variations. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

What is claimed is:

1. A centrifugal pump for pumping a slurry containing a solids fluid mixture, comprising:

a shell having a central axis including:

a front wall and a spaced back wall;

a generally continuous outer side wall extending between the front wall and the rear wall; a discharge nozzle disposed tangentially with respect to the side wall;

a suction inlet defined in the front wall about the axis for allowing the slurry to enter the shell;

an impeller rotatably supported within the shell about the central axis, the impeller including:

a plurality of vanes, each vane having an inlet angle and an exit angle;

wherein the vane inlet angles provide a substantially shock-free entry for the solids fluid mixture entering the impeller; and wherein the vane inlet angle is further defined by the equation:

$$\text{inlet angle} = \text{artan}\frac{C_{ml}}{U_l}$$

where: $C_{m1}$ is the estimated meridional velocity of the solids;

$U_1$ is the tangential velocity of the inlet edge of a vane.

2. The centrifugal pump of claim 1, wherein the vane inlet angle is determined in part by the velocity and concentration of the solids entering the shell.

3. The centrifugal pump of claim 1, wherein the vanes comprise a blade having a plurality of angles whereby the blade is twisted.

4. The centrifugal pump of claim 1, wherein the centrifugal pump operates at an efficiency between about 75% and 95%.

5. The centrifugal pump of claim 1, wherein the solids have a particle size of at least about 100 microns.

6. The centrifugal pump of claim 1, wherein the slurry is not homogeneous.

7. The centrifugal pump of claim 1, wherein the slurry entering the shell is striated having varying degrees of solids concentration.

8. The centrifugal pump of claim 1, wherein the slurry comprises about 15% to about 30% solids.

9. The centrifugal pump of claim 1, wherein the impeller further including:

a circular back shroud;

a spaced parallel annular shroud;

a circular opening defined by the annular shroud about the central axis in fluid communication with the suction inlet, the circular opening having a diameter approximately equal to the diameter of the suction inlet; and a central shaft rotatably supported on the shell and extending along the axis, the shaft being operably engaged with the back shroud and connected to a prime mover for rotating the impeller about the axis.

10. A centrifugal pump for pumping a slurry having a striated profile of liquid and solids wherein a lower half of the profile having a greater concentration of solids than an upper half of the profile, the centrifugal pump comprising:

a shell having a central axis including:

a front wall and a spaced back wall;

a generally continuous outer side wall extending between the front wall and the rear wall; a discharge nozzle disposed tangentially with respect to the side wall;

a suction inlet defined in the front wall about the axis for allowing the slurry to enter the shell;

an impeller rotatably supported within the shell about the central axis, the impeller including:

a plurality of vanes, each vane having an inlet angle optimized for providing a substantially shock-free entry of slurry into the pump relative to a velocity profile of the solids contained within the lower half of the slurry profile; and wherein the vane inlet angle is further defined by the equation:

$$\text{inlet angle} = \text{artan}\frac{C_{ml}}{U_l}$$

where: $C_{m1}$ is the estimated meridional velocity of the solids;

$U_1$ is the tangential velocity of the inlet edge of a vane.

11. The centrifugal pump of claim 10, wherein the vanes have a plurality of angles determined by streamtubes representing the velocity of the solids within the slurry at various points within the slurry profile.

12. The centrifugal pump of claim 10, wherein the vane inlet angle is determined in part by the velocity and concentration of the solids entering the shell.

13. The centrifugal pump of claim 10, wherein the slurry comprises about 15% to about 30% solids.

* * * * *